US005746378A

United States Patent [19]

Beadle et al.

[11] Patent Number: 5,746,378

[45] Date of Patent: May 5, 1998

[54] VOLUME REDUCTION MACHINE

[75] Inventors: Charles Donald Beadle, New Westminster; Murray Frank Green, North Vancouver, both of Canada

[73] Assignee: Marathon Equipment Company, Vernon, Ala.

[21] Appl. No.: 494,152

[22] Filed: Jun. 23, 1995

[51] Int. Cl.[6] ..... B02C 19/14

[52] U.S. Cl. ..... 241/99; 241/167; 241/225; 241/236

[58] Field of Search ..... 241/166, 167, 241/224, 236, 225, 99, 243

[56] References Cited

U.S. PATENT DOCUMENTS

| | | | |
|---|---|---|---|
| 30,516 | 10/1860 | Ballantine | 241/225 X |
| 553,092 | 1/1896 | Wtjer | 241/225 |
| 3,489,354 | 1/1970 | Harper et al. | 241/99 X |
| 3,504,621 | 4/1970 | Qualheim | 241/99 X |
| 3,991,944 | 11/1976 | Balkoff | 241/224 X |
| 4,015,782 | 4/1977 | Granite | 241/243 X |
| 4,374,573 | 2/1983 | Rouse et al. . | |
| 4,529,134 | 7/1985 | Williams . | |
| 4,627,581 | 12/1986 | Holiman et al. . | |
| 4,690,337 | 9/1987 | Stiefel . | |
| 4,703,899 | 11/1987 | Lodovico . | |
| 4,729,515 | 3/1988 | Wagner . | |
| 4,923,126 | 5/1990 | Lodovico et al. . | |
| 5,042,634 | 8/1991 | Gulmini . | |

FOREIGN PATENT DOCUMENTS

| | | |
|---|---|---|
| 1206796 | 7/1986 | Canada . |
| 1239047 | 7/1988 | Canada . |
| 1244279 | 11/1988 | Canada . |
| 2053373 | 10/1991 | Canada . |
| 2109966 | 11/1993 | Canada . |

*Primary Examiner*—Mark Rosenbaum
*Attorney, Agent, or Firm*—Joseph W. Berenato, III

[57] ABSTRACT

A volume reduction machine for crushing beverage containers has a pair of feed rolls and a pair of crusher rolls. The feed rolls in spaced relationship to a feed plate, urge containers to be crushed, while puncturing them. The feed rolls comprise a plurality of spaced feed discs and are aligned to overlap to ensure self cleaning. The crusher rolls comprise a plurality of closely-spaced discs. Spaces between discs slightly exceeding the thickness of the disc. The crusher rolls are offset such that the discs of one roll align with the spaces between discs of the other roll. The crusher rolls have an adjustable gap and are aligned with a lower edge of the feed plate. The discs forming the crusher rolls include circumferential notches of a given size and shape to deform plastic beverage containers beyond their modulus of elasticity thereby overcoming the problem of such containers springing back after crushing. An oscillating horizontal bar provides a debridging dejamming feature to the machine.

5 Claims, 5 Drawing Sheets

Fig. 1
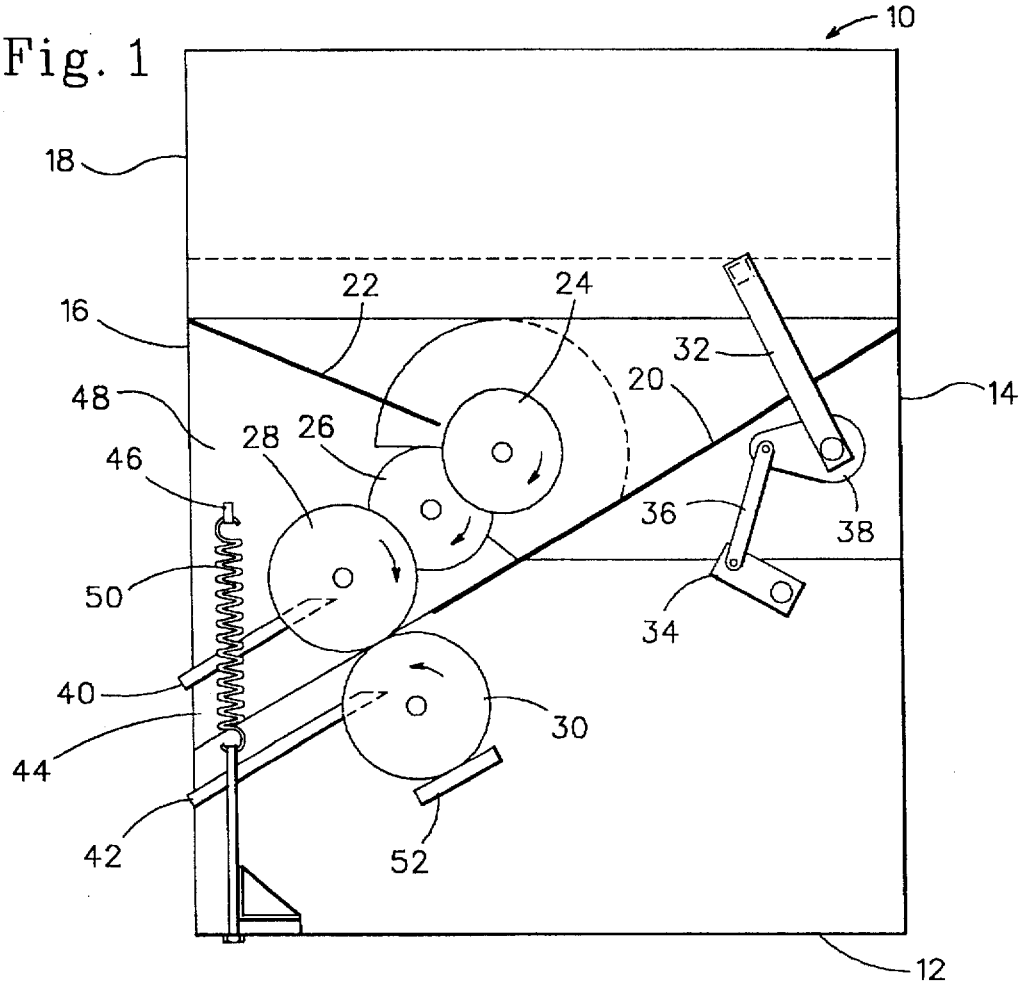
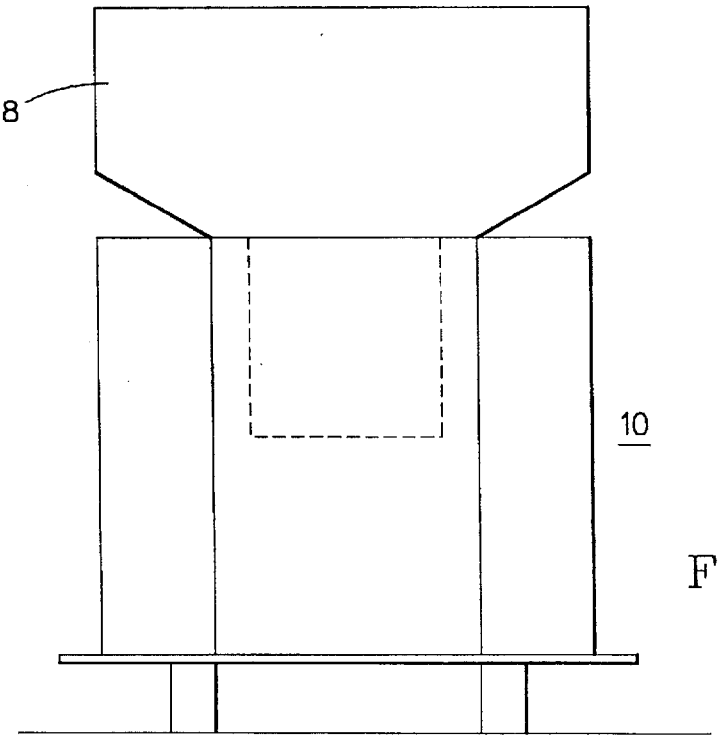
Fig. 2

VOLUME REDUCTION MACHINE

FIELD OF THE INVENTION

The present invention relates to volume reduction machines and is particularly concerned with reduction of beverage containers for storage or shipment for recycling.

It is well known to crush, shred, or otherwise compact cans, plastic bottles and other beverage containers to save storage space in recycling depots and in transportation. Known machines flatten beverage containers using rollers or rotating drums. These machines work well with aluminum cans but may not successfully flatten plastic containers as they tend to spring back after crushing.

Separate machines for plastics have been developed that shred or pulverize plastic containers to reduce their volume.

SUMMARY OF INVENTION

An object of the present invention is to provide an improved volume reduction machine.

In accordance with an aspect of the present invention there is provided a volume reduction machine comprising a frame; a feed plate attached to the frame and having a transverse edge; and first and second crusher rolls rotatably coupled to the frame adjacent the transverse edge of the feed plate; whereby when the first and second crusher rolls are counter-rotated away from the feed plate, containers placed thereon are drawn into and between the first and second crusher rolls and crushed to reduce the containers volume.

In accordance with a further aspect of the present invention there is provided a volume reduction machine comprising a frame including end, side and bottom panels; first and second feed plates disposed within the frame and defining an inlet; a hopper disposed on top of the frame and communicating with the inlet; first and second feed rolls rotatable mounted within the inlet and rotatable for urging containers into the inlet first and second crusher rolls rotatable mounted adjacent a transverse edge of the first feed plate for receiving containers from the feed rollers for crushing; first and second forks disposed adjacent the first and second feed rolls and defining an outlet; and an elongate bar disposed transversely above the first feed plate and pivotally connected to the frame for back-and-forth movement.

In accordance with another aspect of the present invention there is provided a volume reduction machine comprising a frame including end, side and bottom panels; a first feed plate disposed at one end of the frame adjacent an upper edge thereof and inclined toward the center thereof; a second feed plate disposed at the other end of the frame adjacent an upper edge thereof and inclined toward the first feed plate, the first and second feed plater forming an inlet therebetween; first and second feed rolls transversely and rotatably mounted above the first feed pate, each feed rolls including a plurality of feed discs spaced along its length, the first and second feed rolls being aligned to provide an over lap of respective feed discs; first and second crusher rolls transversely and rotatably mounted adjacent a transverse lower edge of the first feed plate, each crusher roll including a plurality of crusher plates spaced along its length, the first and second crusher rolls being aligned to provide an offset between respective crusher discs and to provide a predetermine gap between the first and second crusher rolls, the first crusher roll being aligned with the second feed roll to provide an overlap between respective discs; first and second forks transversely disposed within the frame and adjacent respective first and second crusher rolls and defining an outlet; and a hopper disposed on top of the frame and communicating with the inlet.

BRIEF DESCRIPTION OF THE DRAWINGS

The present invention will be further understood from the following description with reference to the drawings in which:

FIG. 1 illustrates, in a cutaway side elevation, a volume reduction machine in accordance with an embodiment of the present invention;

FIG. 2 illustrates, in a front elevation, the volume reduction machine of FIG. 1;

Referring to FIG. 1 there is illustrated a volume reduction machine in accordance with an embodiment of the present invention. The volume reduction machine 10 includes a base 12, ends 14 and 16, a hopper 18, an inclined feed plate 20, an auxiliary feed plate 22. Positioned at the end of auxiliary feed plate 22 is a first feed roll 24 spaced away from the feed plate 20. A second feed roll 26 is spaced more closely to feed plate 20. There are a pair of crusher rolls 28 and 30, adjacent the lower edge of feed plate 20. Near the upper end of feed plate 20 is a debridger 32, which is coupled to a crank arm 34 by a connecting rod 36 and a torque group limiter 38. Adjacent crusher rolls 28 and 30 are forks 40 and 42, respectively, forming an outlet 44. A frame portion including a guide bar 46 together with a pivotal mount 48, carrying the second feed roll 26 and the upper crusher roll 28 and a biasing spring 50 provide for biased displacement of the second feed roll 26 and the upper crusher roll 28. The lower crusher roll 30 is provided with a bearing adjustment block 52 for adjusting spacing between the first crusher rolls 28 and the second crusher roll 30.

Figure 3:
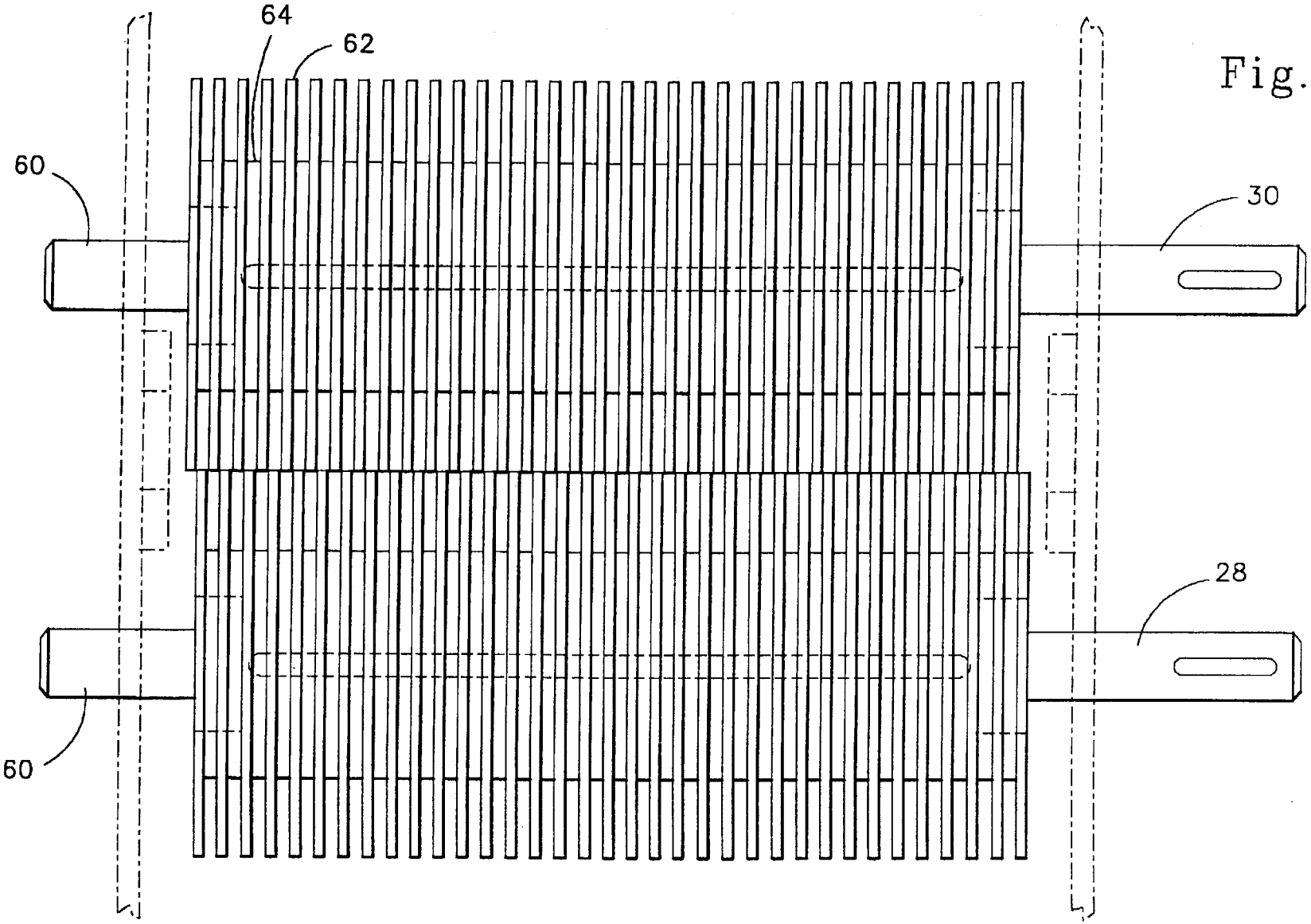
FIG. 3 illustrates, in a front elevation, crusher rolls of FIG. 1.

In operation, containers to be crushed are loaded into the open top of hopper 18 and through gravity come into contact with the feed plate 20 and auxiliary feed plate 22. The containers then move down the feed plates towards the first feed roll 24. The debridger 32 moves back-and-forth through an arch toward and away from the first feed roll 24 thereby preventing containers from becoming jammed in the hopper. The first feed roll 24 being spaced further from the feed plate 20 engages the containers first and passes the container on the second feed roll 26, which in turn, passes the container to the converging crusher rolls 28 and 30. After passing between crusher rolls 28 and 30 the containers are ejected out through the outlet 44. Both feed rolls 24 and 26 and crusher rolls 28 and 30 are formed from a plurality of plates spaced apart from each other to form the roll. The feed rolls and crusher rolls are explained in further detail in conjunction with FIGS. 3, 4, 5, and 6.

The volume reduction machine in accordance with the present invention includes a number of features as explained above. The debridger through its back-and-forth action prevents bridging or jamming of containers in the hopper and forces the containers into the feed rolls for increased throughput. The two feed rolls being composed of plurality of stacked discs are mounted so that their respective discs interleave and in this way the second feed roll 26 prevents any of the container from being jammed in between the discs of the first feed roll. A similar overlapping occurs between the second feed roll 26 and the first crusher roll 28. The forks 40 and 42 extend between the plates of the crusher rolls 28 and 30, respectively, thereby preventing containers from becoming jammed in the discs forming the crusher rolls. Through this arrangement of overlapping rolls and with the addition of the forks, the volume reduction mechanism within the volume reduction machine 10 is self-cleaning and avoids having materials lodged within the various rolls. In the event that a foreign object, which is not crushable, passes through the machine, the frame portion including the guide bar 46, the mounting bracket 48 and the biasing spring 50, pivots about the axis of feed roll 24 allowing the upper crusher roll 28 and the feed roll 26 to move vertically in order to pass the foreign object through without damaging either of the feed roll 26 or crusher rolls 28 or 30.

Referring to FIG. 2 there is illustrated in a front elevation the volume reduction machine of FIG. 1. FIG. 2 shows the general structure of the frame of the machine including the hopper 18.

Referring to FIG. 3 there is illustrated, in a front elevation, crusher rolls of FIG. 1. Crusher rolls 28 and 30 each include a shaft 60 and a plurality of stacked discs 62 and spacers 64. The spacer 64 are thicker than the disk 62 in order to provide a space larger than the thickness of the disc. The crusher rolls 28 and 30 are mounted such that the discs of one are offset from the disc of the other and align substantially with the space of the adjacent crusher rolls.

Figure 4:
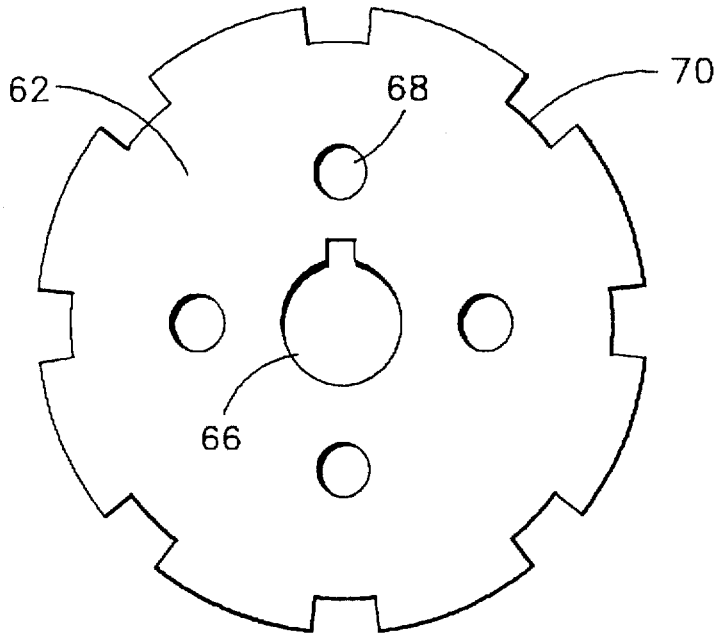
FIG. 4 illustrates a crush disc of crusher rolls of FIG. 3.

Referring to FIG. 4, there is illustrated a crusher disc of crusher rolls 28 and 30. Each disc 62 includes a central hole 66 mounting on the shaft 60 and a plurality of holes 68 for receiving assembly bolts (not shown in the figures) and a plurality of circumferential notches 70. Each notch 70 has a width less than an adjacent portion of the circumference of the disc 62. Each notch 70 extends in depth about one-half its width. The central hole 66 includes a key notch 72.

The key notch 62 and bolt holes 68 cause the discs to align with each other and positionally on the shaft 60 when assembled to form crusher rolls 28 and 30. The specific size and shape of notches 70 are chosen to ensure that, in operation, the crusher rolls impart a pattern of deformation on a container being crushed, that causes the material of the container to exceed its modulus of elasticity. In that way, the memory of plastic containers is overcome and partial return to original shape after crushing is prevented.

Thus, the volume reduction machine has the advantage of being able to crush containers of various material including steel and aluminum cans, plastic bottles and laminated plastic/paper products.

Figure 5:
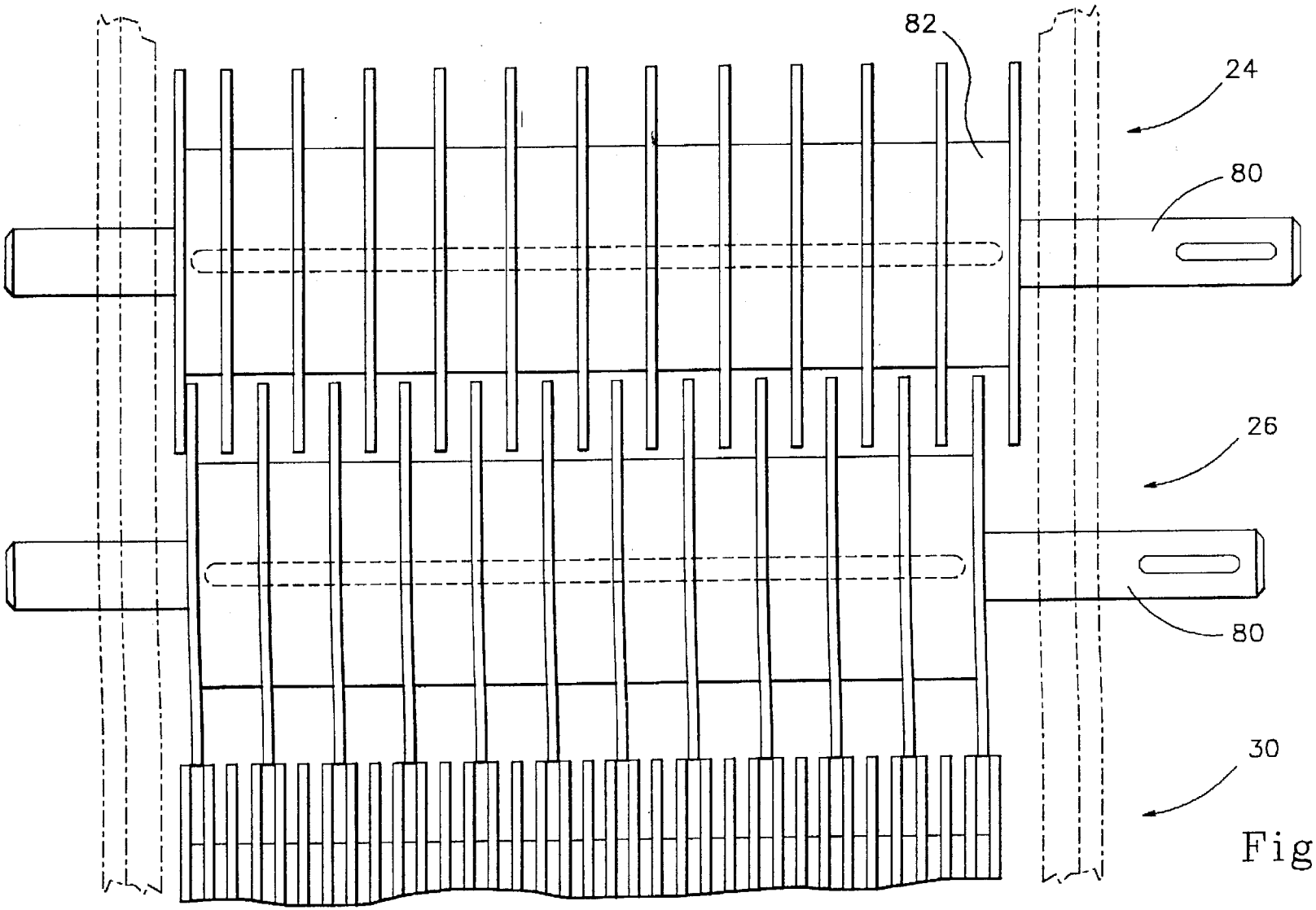
FIG. 5 illustrates, in a plan view, feed rolls of FIG. 1.

Referring to FIG. 5, there is illustrated feed rolls of FIG. 1. The feed rolls 24 and 26 each include a shaft 80, a plurality of feed discs 82 and a plurality of spacer rings 84. The plan view of FIG. 5 shows the spatial relationship of feed rolls 24 and 26, the alignment of their respective feed discs 82, and the alignment of the feed roll 26 and the crusher roll 30. Each feed disc 82 of one feeder roll is aligned substantially with the center of the space between discs 82 of the other feeder roll. As discussed hereinabove, such alignment provides shelf cleaning of the feed rolls. Similarly, each feed disc 82 of the feed roll 26 overlaps a corresponding crusher disc of crusher roll 30. The spacing illustrated provides for a feed disc 82 overlapping between every third crusher disc 62.

Figure 6:
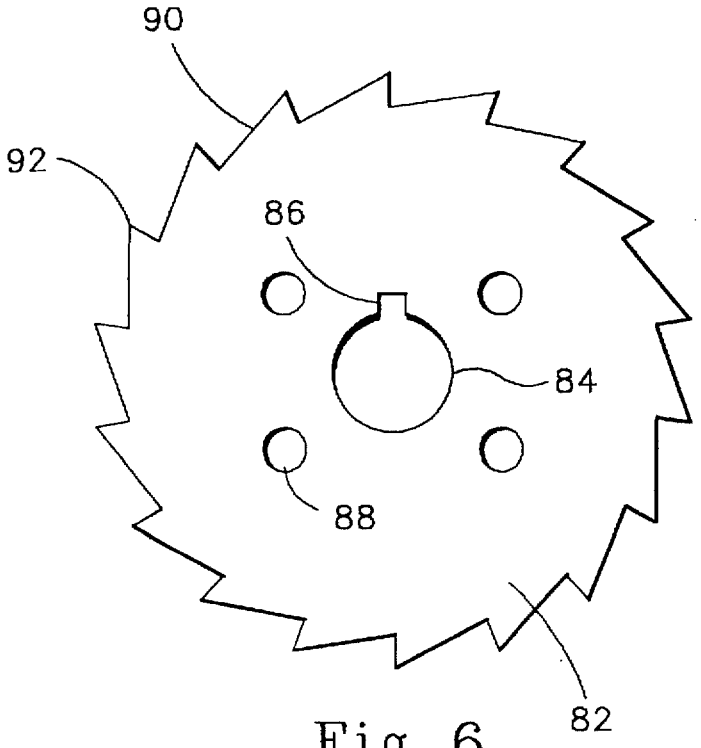
FIG. 6 illustrates a feed disc of the feed rolls of FIG. 5.

Referring to FIG. 6, there is illustrated a feed disc of feed rolls of FIG. 5. Each feed disc 82 includes a central hole 84 having a key notch 86 and a plurality of bolt holes 88. The circumference of the feed disc 82 includes a plurality of triangular teeth 90, giving the feed disc 82 a circular saw blade appearance. The triangular teeth 90 are sized and shaped to ensure proper feeding of containers to the crusher rolls. Each tooth 90 having a sharp point 92 for puncturing containers thereby facilitating crushing.

Figure 7:
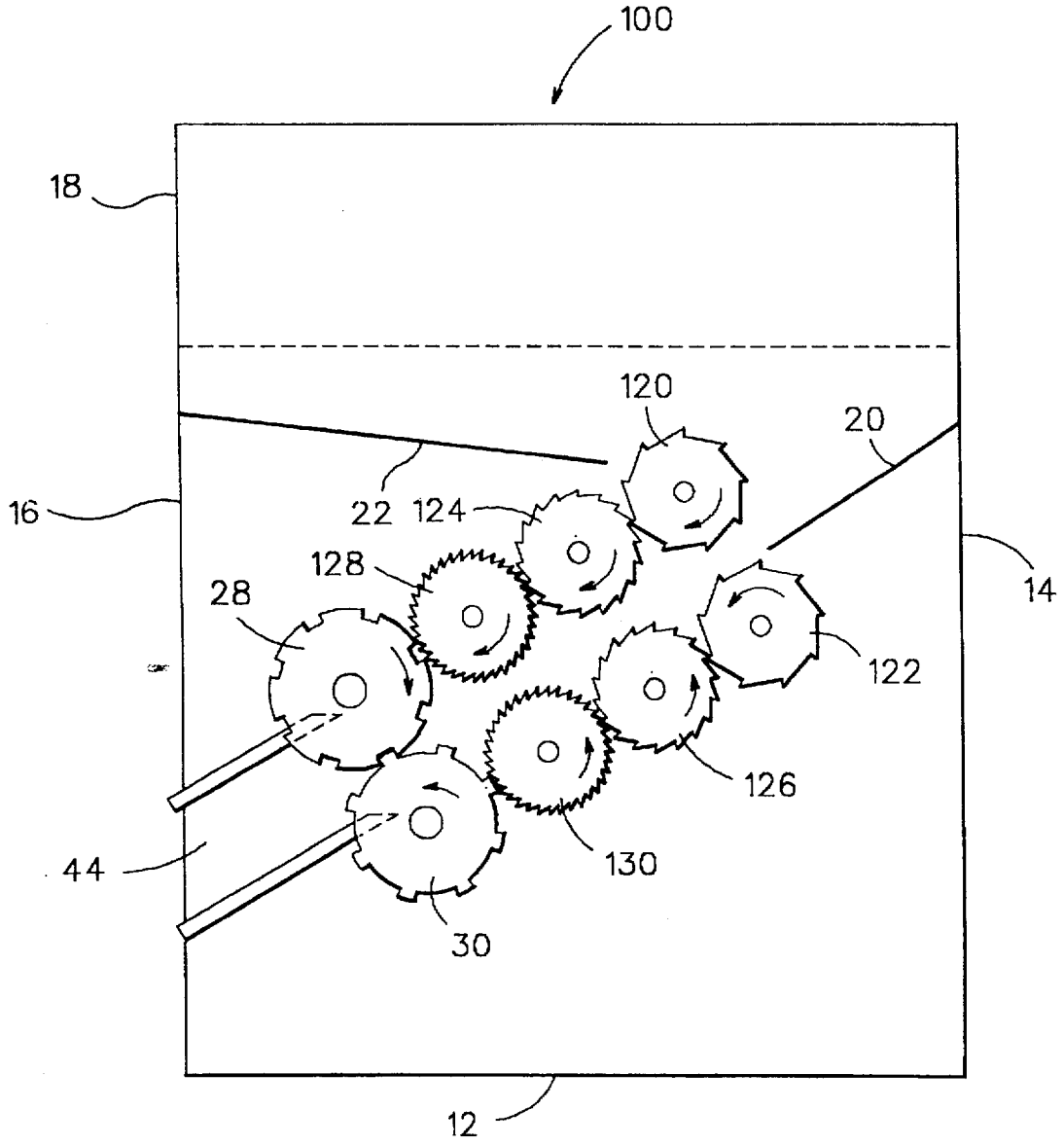
FIG. 7 illustrates a second embodiment of the invention.

Referring to FIG. 7, there is illustrated a volume reduction machine in accordance with a second embodiment of the present invention. For simplicity only feed plates, feed rolls and crushing rolls are illustrated. The volume reduction machine 100 includes feedplates 20 and 22 and crushing rolls 28 and 30 as in the embodiment of FIG. 1. In addition, the volume reduction machine 100 includes feed rolls 120, 122, and cap removal rolls 124, 126, 128, and 130 are ranged in upper and lower pairs. Feed rolls 120 and 122 of the first pair are rotably mounted transversely in the frame (not shown in FIG. 7) adjacent a lower edge of the feed plate 20. The feed rolls 120 and 122 are counter rotating to draw containers from the feed plate 20 toward a first pair of cap removal rolls 124 and 126. The cap removal rolls 124 and 126 have a greater number of teeth than feed rolls 120 and 122 and the teeth of cap removal roll 126 are oriented oppositely to those of cap removal roll 124. Similarly, a second pair of cap removal rolls 128 and 130 is included between the first pair of cap removal rolls 124 and 126 and the crusher rolls 28 and 30. The second pair has a greater number of teeth than the first pair. The teeth of cap removal roll 130 are oriented oppositely to those of cap removal roll 128. The spacing between pairs of feed and cap removal rolls decreases in the direction of the crusher rolls 28 and 30. The number of teeth for example are 8 for the plates of the feed roll pair, 16 for the plates of the first cap removal pair and 32 for the plates of the second cap removal pair. As with the embodiment of FIG. 1, the plates of one roll overlap with the plates of adjacent rolls to premote self cleaning. Unlike the embodiment of FIG. 1, the cap removal rolls 124 and 128 are rotated at a faster rate than the remaining feed and cap removal rolls.

In operation, the lower feed roll 122, and lower cap removal rolls 126 and 130 are rotated at the same speed as upper feed roll 120. However, upper removal rolls 124 and 128 are rotated at a slightly faster rate, for example, 15% faster. The speed differential between the upper and lower cap removal rolls of the first and second pairs, together with the reverse oriented teeth of the lower cap removal rolls 126 and 130 creates a "scrubbing" action that removes high density polyethylene caps from plastic bottles with about a 95% efficiency.

Numerous modifications, variations, and adaptations may be made to the particular embodiments of the invention described above without departing from the scope of the invention, which is defined in the claims.

What is claimed is:

1. A volume reduction machine, comprising:

a) a frame having an end, side, and bottom panels;

b) a first feed plate disposed at one end of said frame adjacent an upper edge thereof and inclined toward the center thereof, c) a second feed plate disposed at an opposite end of said frame adjacent an upper edge thereof and inclined toward said first feed plate, said first and second feed plates forming an inlet therebetween;

d) first and second feed rolls transversely and rotatively mounted above said first feed plate, each feed roll including a plurality of feed disks spaced along the length thereof and said first and second feed rolls being aligned and providing an overlap of respective feed disks;

e) first and second crusher rolls transversely and rotatively mounted adjacent a transverse lower edge of said first feed plate, each crusher roll including a plurality of crusher plates spaced along the length thereof and said first and second crusher rolls being aligned to provide an offset between respective crusher disks and to provide a predetermined gap between said first and second crusher rolls, said first crusher roll being aligned with said second feed roll to provide an overlap between respective feed disks;

f) first and second forks transversely disposed within said frame and adjacent said first and second crusher rolls for defining an outlet;

g) a hopper positioned on said frame and communicating with the inlet; and h) a first pair of cap removal rolls including an upper cap removal roll and a lower cap removal roll, said first pair of cap removal rolls rotatably mounted to said frame and said upper cap removal roll adapted to rotate at a rate faster than the rate at which said lower cap removal roll rotates.

2. A machine as claimed in claim 1 wherein the first pair of cap removal rolls have teeth, the teeth of the upper cap removal roll oriented toward the crusher rolls and the teeth of the lower cap removal roll oriented oppositely to the adjacent teeth of the upper cap removal roll.

3. A machine as claimed in claim 2 further comprising a second pair of cap removal rolls including an upper cup removal roll and a lower cap removal roll, the first pair of cap removal rolls rotably disposed in the frame the upper cap removal roll adapted to rotate at a faster rate than the lower cap removal roll.

4. A machine as claimed in claim 3 wherein the second pair of cap removal rolls have teeth, the teeth of the upper cap removal roll oriented toward the crusher rolls and the teeth of the lower cap removal roll oriented oppositely to the adjacent teeth of the upper cap removal roll.

5. A machine as claimed in claim 4 wherein the first pair of feed rolls has a predetermined number of teeth, the first pair of cap removal rolls has twice the predetermined number of teeth and the second pair of cap removal rolls has four times the predetermined number of teeth.

* * * * *